US005699900A

United States Patent [19]

Artis

[11] Patent Number: 5,699,900

[45] Date of Patent: Dec. 23, 1997

[54] CONTACT LENS CASE WITH AUTOMATIC COUNTER

[76] Inventor: Derrick L. Artis, 252 Gallatin St., N.W., Washington, D.C. 20011

[21] Appl. No.: 688,269

[22] Filed: Jul. 29, 1996

[51] Int. Cl.[6] ..... A45C 11/04

[52] U.S. Cl. ..... 206/5.1; 206/459.1; 206/534; 134/137

[58] Field of Search ..... 206/5.1, 210, 459.1, 206/534; 134/137, DIG. 901; 116/279, 306, 285, DIG. 28, 307

[56] References Cited

U.S. PATENT DOCUMENTS

| | | | |
|---|---|---|---|
| 3,770,113 | 11/1973 | Thomas | 134/901 |
| 3,871,395 | 3/1975 | Murry . | |
| 3,939,968 | 2/1976 | Ryder | 206/459.1 |
| 4,228,136 | 10/1980 | Thomas . | |
| 4,396,583 | 8/1983 | Leboeuf . | |
| 4,721,124 | 1/1988 | Tuerkheimer et al. . | |
| 4,750,610 | 6/1988 | Ryder . | |
| 4,807,750 | 2/1989 | Ryder et al. | 206/5.1 |
| 4,889,693 | 12/1989 | Su et al. . | |
| 5,046,605 | 9/1991 | Levrant . | |
| 5,101,967 | 4/1992 | Sibley . | |
| 5,280,834 | 1/1994 | Berkley . | |
| 5,356,012 | 10/1994 | Tang et al. . | |
| 5,366,078 | 11/1994 | Braum | 134/901 |
| 5,388,686 | 2/1995 | Kanner et al. | 206/5.1 |
| 5,452,792 | 9/1995 | Zautke et al. | 134/901 |

FOREIGN PATENT DOCUMENTS

| | | |
|---|---|---|
| WO 89/00430 | 1/1989 | WIPO . |

*Primary Examiner*—Paul T. Sewell
*Assistant Examiner*—Nhan T. Lam

[57] ABSTRACT

A contact lens storage device and method is provided. The contact lens storage device includes a housing, a cover for the housing and a counter. The cover is cooperatively arranged with and attached to the housing such that the counter automatically operates to display number of days that the contact lenses have been worn by the contact lens wearer. Thus, the contact lens wearer is likely to refrain from using contact lenses beyond the useful life of the lenses.

10 Claims, 3 Drawing Sheets

CONTACT LENS CASE WITH AUTOMATIC COUNTER

FIELD OF THE INVENTION

The present invention generally relates to a contact lens storage system. More particularly, the present invention relates to a device and method for storing contact lenses and for tracking the number of uses of the contact lenses.

BACKGROUND OF THE INVENTION

In recent years, the popularity of disposable contact lenses has risen dramatically. Eye care professionals estimate that at least 33% of the contact lens users wear disposable contact lenses. The typical useful life of disposable contact lenses is between 7 to 30 days. If the user continues to wear the lenses after their useful life, numerous ocular complications may be incurred. Some of these complications may be sight threatening.

The most common use of disposable contact lenses is on a daily wear basis. Daily wear disposable contact lenses should be worn only while the wearer is awake. When they are not being worn, they should be stored in a disinfecting solution. Several types of devices have been developed for storing contact lenses. U.S. Pat. No. 5,101,967 relates to a device for storing contact lenses in a vertically juxtaposed manner. U.S. Pat. No. 4,889,693 discloses a container for storing contact lenses in a back-to-back arrangement.

It is important for the contact lens wearer to accurately track the number of days that the contact lenses have been worn. U.S. Pat. No. 5,280,834 attempts to address this issue by providing a contact lens storage case with a manually operable dial. The storage case has separate containers for the left and right lenses disposed on a substrate. In order to accurately track the number of uses of the lenses, the contact lens wearer must manually turn the dial each time the contact lenses are placed in their respective containers. If the contact lens wearer forgets to turn the dial, he/she is likely to lose track of the number of days that the contact lenses have been worn, thus increasing the chances of ocular complications. Accordingly, there is a great need in the industry for a storage container that automatically tracks the number of uses of the contact lenses.

SUMMARY OF THE INVENTION

The present invention provides a reliable, user-friendly system for storing contact lenses and tracking the number of uses of the contact lenses. A feature of this invention is that the number of uses of the contact lenses is automatically displayed to the contact lens wearer each time he/she inserts the contact lenses into or removes the contact lenses from the storage device. No manual interaction from the contact lens wearer is necessary to determine the number of uses of the contact lenses other than the normal act of opening and closing the storage device to store the contact lenses.

In accordance with one aspect of the invention, the storage device includes a housing having an open end and a closed end base. A cover is provided and is removably attachable to the open end of the housing. A contact lens retaining member is coupled to the cover and is operatively associated with a counter which tracks the occurrence of events such as the number of uses of the contact lenses.

In accordance with another aspect of the invention, the cover may form a seal with the housing that is substantially liquid tight. In addition, the counter may be operatively arranged to engage the contact lens retaining member when the cover is attached to the open end of the housing and to disengage the contact lens retaining member when the cover is removed from the housing thereby automatically counting a number of times that the cover is removed from or attached to the housing which is also a measure of the number of uses of the contact lenses.

In accordance with yet another aspect of the invention, a method for storing contact lenses and for tracking the number of uses of the contact lenses is provided. The contact lens wearer selects a contact lens storage device including a container having a counter, a cover, and a contact lens retaining member. The contact lens retaining member may be attached to and extend from the cover. The contact lens wearer then places the contact lenses in the contact lens retaining member after the contact lenses have been worn. The contact lens wearer then attaches the cover to the container thereby automatically activating the counter to display a count representing the number of uses of the contact lenses.

The invention provides an advantage in that through normal storage of the contact lenses, the contact lens wearer may track the number of uses of the contact lenses and easily determine the number of days that the lenses have been worn. Thus, the contact lens wearer is likely to wear the lenses only for their useful life and the risk of ocular complications is thereby greatly reduced.

DETAILED DESCRIPTION OF THE DRAWINGS

The present invention provides an inexpensive, reliable device for storing contact lenses and for tracking the number of uses of the contact lenses. Generally, the device of the present invention includes a housing, a cover for the housing, and a contact lens retaining member attached to the cover. A counter is provided to track the number of times that the cover is removed from or engaged with the housing. It is recommended that the contact lens wearer store the contact lenses in solution after each day's use. Hence, in a preferred embodiment, the number of times that the contact lens wearer removes or engages the cover with the housing represents the number of days that the contact lens have been worn.

In accordance with an embodiment of the invention, a housing 10 is provided to store the contact lenses. The housing 10 includes an open end 12 and a closed end base 14. The housing 10 is preferably of sufficient volume to hold enough disinfecting solution to allow the contact lenses to be completely submerged.

A cover 20 is provided for closing and sealing the housing 10. The cover 20 may be, for example, a simple plastic cap. Preferably, when the cover 20 is attached to the housing 10, a substantially liquid tight seal is formed.

Figure 1:
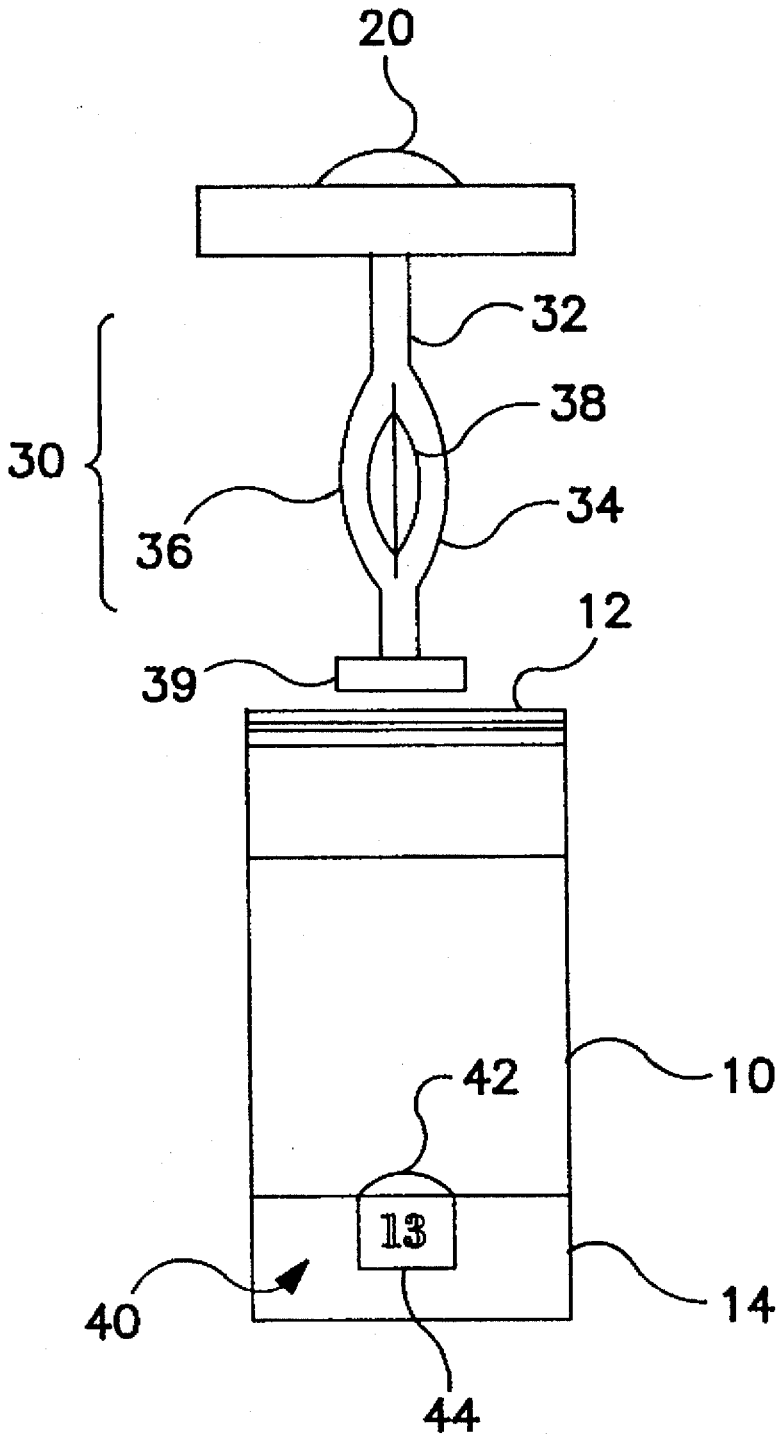
FIG. 1 shows a front view of the device with the contact lens retaining member removed from the housing.

To facilitate formation of the seal between the cover 20 and the open end 12 of the housing 10, the top portion of the housing 10 proximate to the open end 12 may be threaded as shown in FIG. 1. Correspondingly, the inner circumference of the cover 20 may also be threaded. Alternatively, the cover 20 may also be interference fit onto the open end 12 of the housing 10.

Figure 2:
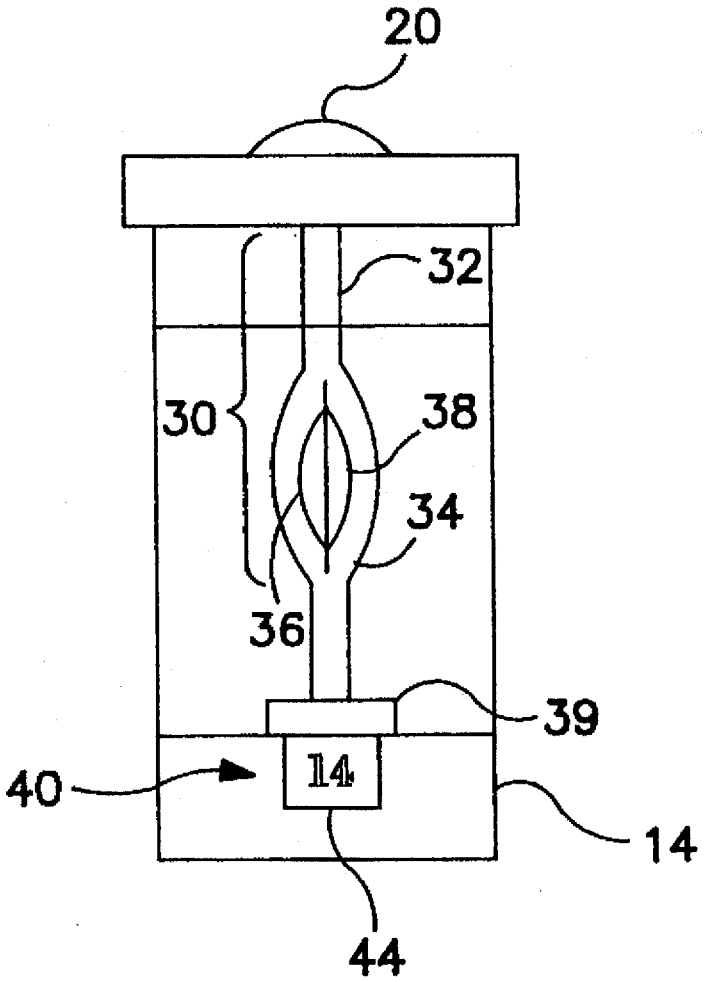
FIG. 2 illustrates a front view of the device with the contact lens retaining member disposed in the housing.

A contact lens retaining member 30 may be attached to or integrally formed with the cover 20. Preferably, the contact lens retaining member 30 includes a support 32 coupled to the cover 20 at one end and a lens holder 34 attached to the stem at a second end. The lens holder 34 preferably includes left and right lens baskets 36, 38. Preferably, the lens baskets 36, 38 are opposed to each other such that the left lens basket 36 faces the right lens basket 38. Alternatively, the lens baskets 36, 38 may be axially aligned along the support 32. Preferably, the contact lens retaining member 30 further includes a base portion extending from the contact lens holder 34 as depicted in FIGS. 1 and 2.

Figure 3:
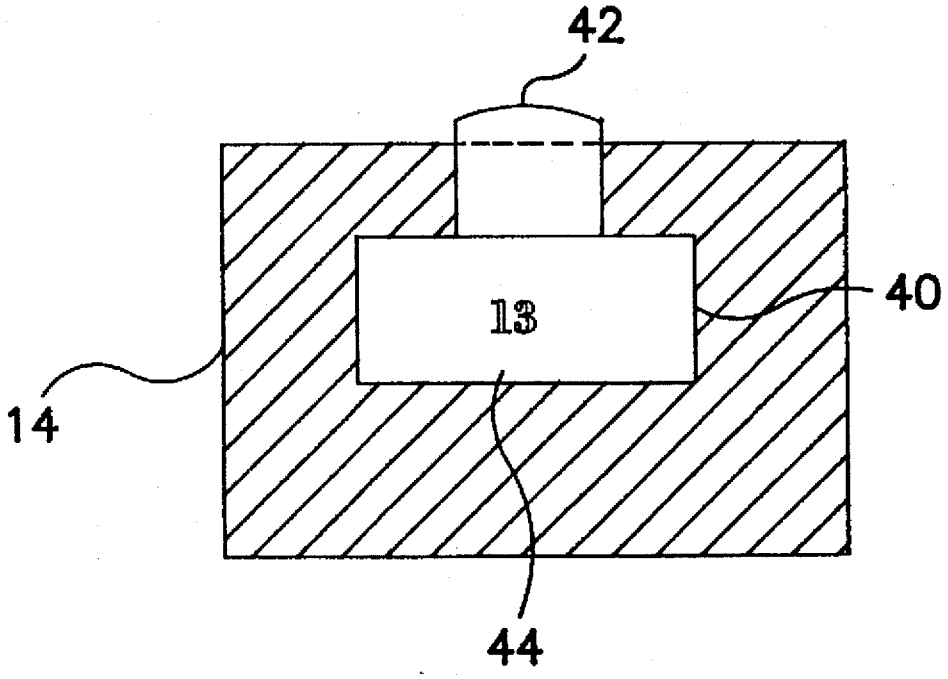
FIG. 3 is a partial cross sectional view of the closed end base including the counter.

In accordance with the invention, a counter 40 is associated with the housing 10. As illustrated in FIGS. 1–3, the counter 40 may be disposed in the closed end base 14 of the housing 10. Preferably, the counter 40 is a simple mechanical device activated by contact with the base of the contact lens retaining member 30. For example, the counter 40 may be a simple cam and lever device. Alternatively, the counter 40 may be a ball button or push button indicator type device. Simple mechanical counters of the foregoing type are well known to those of skill in the art. FIG. 3 illustrates a particularly preferred push button type counter including a button 42. It is preferable that the button 42 be placed directly in the path of the contact lens retaining member 30 to ensure that each time the cover 20 is engaged with the housing 10 the contact lens retaining member 30 depresses the button 42.

Preferably the counter 40 operates to display a count value each time the button 42 is depressed or released. The counter 40 may also include a display 44 for displaying the count value. Preferably, the display 44 is disposed in the closed end base 14 for simplicity and ease of maintenance. The display 44 may be a simple mechanical display or an electrical display such as an LED or LCD display.

The Food and Drug Administration strongly recommends that contact lens wearers store their lenses in disinfecting solution after each use. Typically, a contact lens wearer will insert her lenses in the morning and remove them when he/she retires for the day. Therefore, generally, contact lens wearers store their lenses only once per day. In accordance with a preferred aspect of the invention, each time the contact lenses are stored the counter 40 is automatically operated by the contact lens retaining member 30 to produce a count value. The count value represents an event such as the number of days that the contact lenses have been worn.

For example, FIG. 1 illustrates the contact lens retaining member 30 disengaged from the counter 40. The counter 40 shows a count value of 13. FIG. 2 shows the contact lens retaining member 30 fully engaged with the counter 40 and the counter 40 is incremented to a count value of 14.

To accommodate disposable contact lenses of varying useful lives, the counter 40 may have an adjustable maximum count value to permit the contact lens wearer to customize the counter 40 to her particular pair of contact lenses. Preferably, the counter 40 has a maximum count value consistent with the useful life of standard commercially available contact lenses, e.g., 7, 14 or 30 days. However, the counter 40 may have any maximum count value set by the contact lens wearer.

In accordance with an aspect of the invention, the counter 40 may be reset when it reaches its maximum count value. Further in accordance with this aspect of the invention, the counter 40 may be adjusted to display warning signs after the maximum count value has been displayed and the counter 40 has not been reset. For example, if the maximum count value is 14 days, when the contact lens wearer opens or closes the housing 10 for the fifteenth time, instead of displaying the number 15 in the display window, the counter 40 may display a message such as "RES" (indicating the counter 40 should be reset) on a plain or colored background. Preferably, to attract the contact lens wearer's attention, the background may be a bright fluorescent color such as orange, green or yellow. However, any combination of colors is suitable.

In accordance with an alternate embodiment of the invention, the counter 40 may include a sensor that senses when the cover 20 is completely engaged with the housing 10. The sensor may be disposed in various locations. Preferably, the sensor is disposed in the cover 20. However, e.g., the sensor may be disposed on the end of the contact lens retaining member 30 or on the closed end of the base of the housing 10. Suitable sensors include any electrical, mechanical, optical, electro-optical or electro-mechanical sensor known to those of skill in the art.

While several embodiments of the invention have been described in some detail, it should be understood that the invention encompasses various modifications and alternative forms of those embodiments. Also it should be understood that the specific embodiments are not intended to limit the invention. The invention covers modifications, equivalents and alternatives falling within the spirit and scope of the claims.

I claim:

1. A device for storing contact lenses and for tracking a number of uses of contact lenses comprising:

a housing having an open end and a closed end;

a cover removably attached to the open end of said housing, the cover forming a substantially liquid tight seal with the open end of said housing;

a contact lens retaining member coupled to said cover, said contact lens retaining member including a support having a lens holder disposed at a first end and being coupled to said cover at a second end, and said contact lens retaining member including a base coupled to the lens holder; and a counter that engages said contact lens retaining member when said cover is attached to the open end of said housing and that disengages said contact lens retaining member when said cover is removed from said housing, thereby automatically counting a number of times said cover is removed from and attached to said housing, said counter including a button disposed on the closed end of said housing, the button being positioned to engage the base of said contact lens retaining member.

2. The device of claim 1 wherein the cover includes a plastic cap.

3. The device of claim 1 wherein the lens holder includes first and second lens baskets.

4. The device of claim 3 wherein the first lens basket faces the second lens basket.

5. The device of claim 1 wherein said counter includes a display.

6. The device of claim 1 wherein said counter includes a display showing the count value.

7. The device of claim 6 wherein the display of said counter shows a warning sign when said counter exceeds the maximum count value.

8. The device of claim 7 wherein the warning signal includes a message disposed on a colored background.

9. A device for storing contact lenses and for tracking a number of uses of the contact lenses comprising:

a housing having an open end and a closed end;

a cover removably attached to the open end of said housing;

counting means for counting the number of times that said cover is removed and attached to the open end of said housing, said counting means being disposed on the closed end of said housing;

a contact lens retaining member coupled to said cover, said contact lens retaining member including a support having a lens holder disposed at a first end and being coupled to said cover at a second end, and said contact lens retaining member including a base coupled to the lens holder arranged to engage said counting means on the closed end when said cover is attached to the open end of said housing and to disengage said counting means when said cover is removed from the open end of said housing.

10. The device of claim 9 wherein said counting means includes a predetermined maximum count value.

* * * * *